United States Patent [19]

Heatwole

[11] Patent Number: 4,700,947

[45] **Date of Patent: * Oct. 20, 1987**

[54] AMUSEMENT AND/OR EXERCISING DEVICE

[76] Inventor: Richard L. Heatwole, Rte. 2, Box 309, Corydon, Ind. 47112

[ * ] Notice: The portion of the term of this patent subsequent to Jul. 23, 2002 has been disclaimed.

[21] Appl. No.: 729,587

[22] Filed: May 2, 1985

Related U.S. Application Data

[63] Continuation-in-part of Ser. No. 426,350, Sep. 29, 1982, Pat. No. 4,530,498.

[51] Int. Cl.[4] ..... A63B 23/04

[52] U.S. Cl. ..... 272/146; 272/70

[58] Field of Search ..... 272/146, 70, 93, 114, 272/97, 111, 144, 70.1, 96; 128/25 B

[56] References Cited

U.S. PATENT DOCUMENTS

| | | | |
|---|---|---|---|
| 2,714,007 | 7/1955 | Jordan | 272/57 |
| 2,941,801 | 6/1960 | Pederson | 272/114 |
| 3,560,035 | 2/1971 | Kindel | 273/80.1 |
| 3,612,519 | 10/1971 | Larson | 272/146 |
| 3,836,140 | 9/1974 | Ahrens | 272/54 |
| 3,854,717 | 12/1974 | Judkins et al. | 272/114 |
| 4,252,312 | 2/1981 | Dehan | 272/97 |
| 4,285,516 | 8/1981 | Heatwole | 272/146 |
| 4,530,498 | 7/1985 | Heatwole | 272/146 |

*Primary Examiner*—Richard J. Apley
*Assistant Examiner*—S. R. Crow
*Attorney, Agent, or Firm*—Seidel, Gonda, Goldhammer & Abbott

[57] ABSTRACT

First and second pads are connected by a member which is wider at the bottom than at the top. Each pad has a ground engaging element associated therewith. A generally semi-spherical bearing is provided between each ground engaging element and its associated pad so that the pads may tilt and/or rotate relative to their ground engaging element. A removable insert is provided for limiting maneuverability and thereby facilitating ease of maintaining balance by beginners.

8 Claims, 13 Drawing Figures

FIG. 4
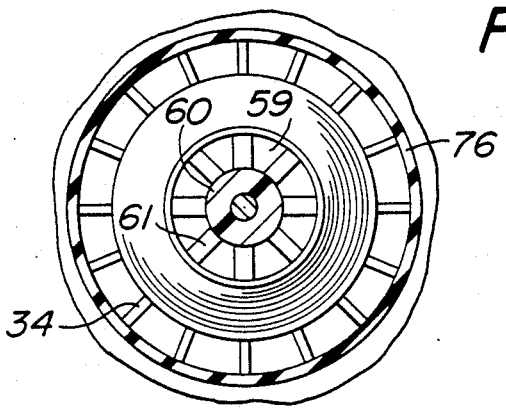
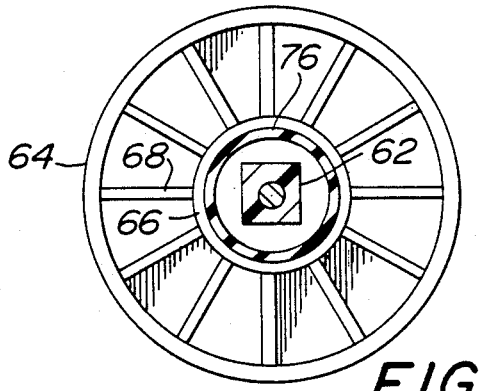
FIG. 7
FIG. 6
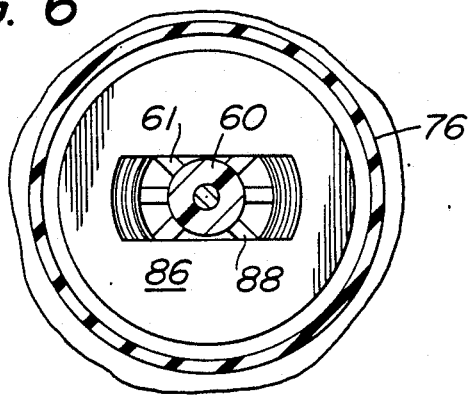

22'
24'
18'
16'
42'
104
96
98
102
76'
64'
60'
74'
92
90
94
36'
40'
58'
100
84'
54'
50'
38'
52'
26'
30'
32'
28'
12'
82'
80'
68'
56'
10
11

AMUSEMENT AND/OR EXERCISING DEVICE

This is a continuation-in-part of my copending patent application Ser. No. 426,350, filed Sept. 29, 1982, now U.S. Pat. No. 4,530,498 which is incorporated herein by reference.

BACKGROUND OF THE INVENTION

The present invention is directed to an improvement over my prior U.S. Pat. No. 4,285,516 dated Aug. 25, 1982 and entitled Amusement and/or Exercising Device. The present invention improves the device disclosed in said patent in a number of areas including ease of manufacture, providing for increased resistance to twisting, providing for ease of learning to use the device, etc.

SUMMARY OF THE INVENTION

The present invention is directed to an amusement and/or exercising device having first and second pads spaced from each other. Each pad is adapted to support one leg of a person. A means integral with the pads and having a cross section which resists twisting is provided for rigidly interconnecting the pads. A discrete ground engaging element is provided below and is associated with each pad. A bearing socket approximately ¾ of a sphere is provided on the bottom of each pad.

A bearing is located in each socket. Each bearing is rigidly connected to one of the ground engaging elements. Each pad is pivotable relative to its associated bearing through a limited arc to thereby facilitate tilting the pads as a unit so that one pad is higher than the other and off the ground. Means are provided for permitting the pad to rotate through a limited arc relative to its associated ground engaging element about a vertical axis.

In another embodiment of the invention, each pad has a movable foot receiving means movable toward and away from the means interconnecting the pads.

Various objects and advantages of the present invention are set forth hereinafter.

DESCRIPTION OF THE DRAWINGS

For the purpose of illustrating the invention, there are shown in the drawings forms which are presently preferred; it being understood, however, that this invention is not limited to the precise arrangements and instrumentalities shown.

FIG. 4 is a sectional view taken along the line 4—4 in FIG. 3.

FIG. 6 is a sectional view taken along the line 6—6 in FIG. 5.

FIG. 7 is a sectional view taken along the line 7—7 in FIG. 5.

DETAILED DESCRIPTION

Figure 8:
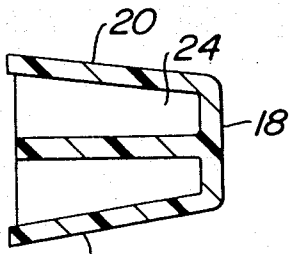
FIG. 8 is a sectional view taken along the line 8—8 in FIG. 2.

The device 10 includes a pair of pads designated 12 and 14. The pads are rigidly connected together and are integral in one piece by way of a connecting means 16. The connecting means 16 includes a top wall 18 and side walls 20, 22. As shown more clearly in FIG. 8, the side walls 20, 22 converge upwardly so that the distance across the bottom of connecting means 16 is greater than the distance across the top wall 18. That feature in combination with the criss-cross ribbing 24 provides substantial stability and resistance to twisting. As will be apparent from FIG. 8, the connecting means 16 is generally an inverted U-shape in cross section.

Figure 1:
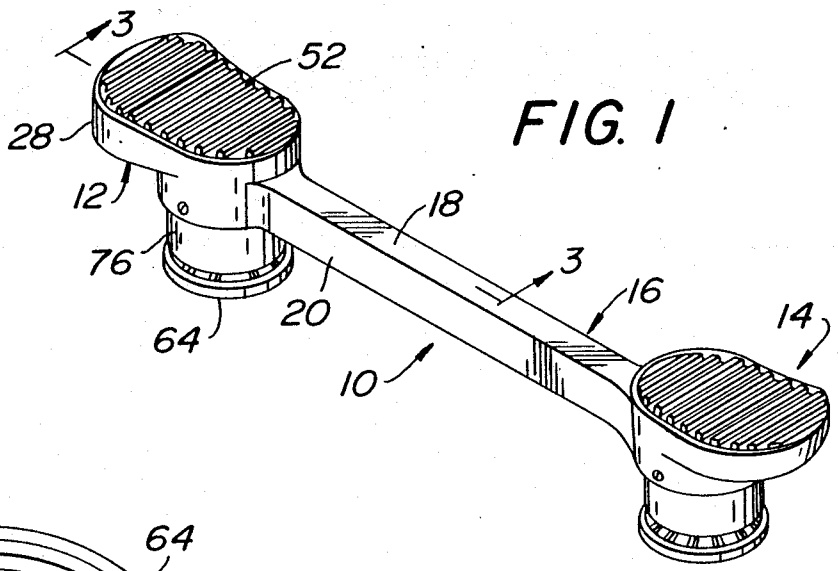
FIG. 1 is a perspective view of the device of the present invention.
Figure 2:
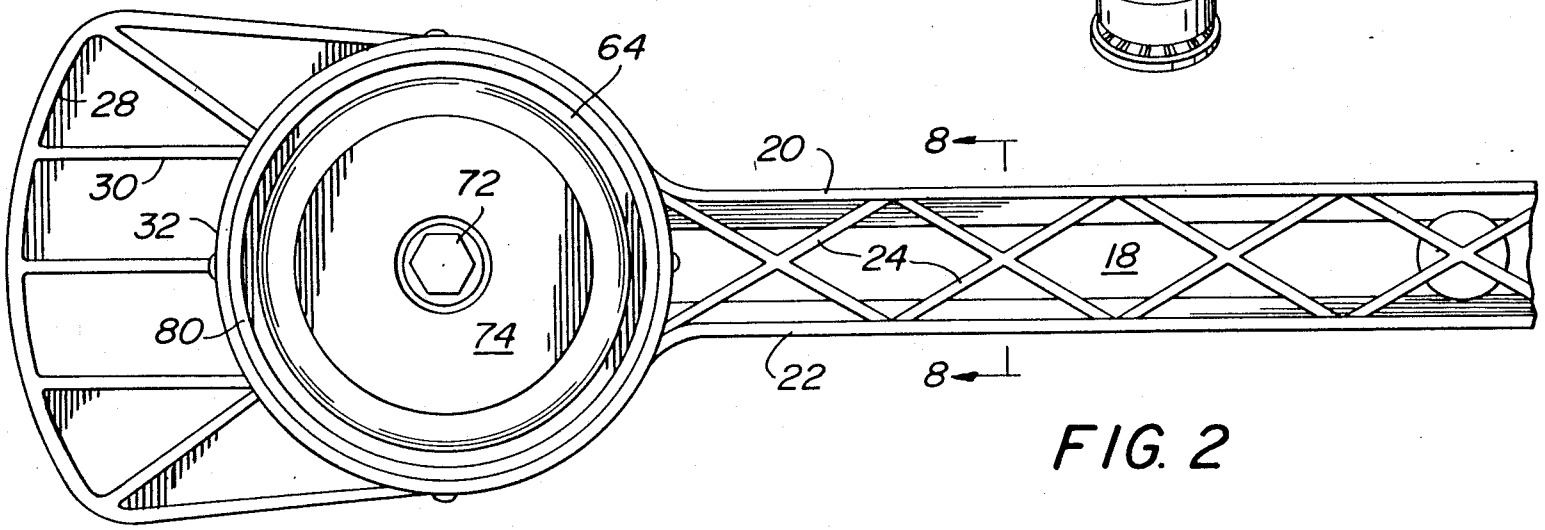
FIG. 2 is a bottom plan view at one end of the device.
Figure 3:
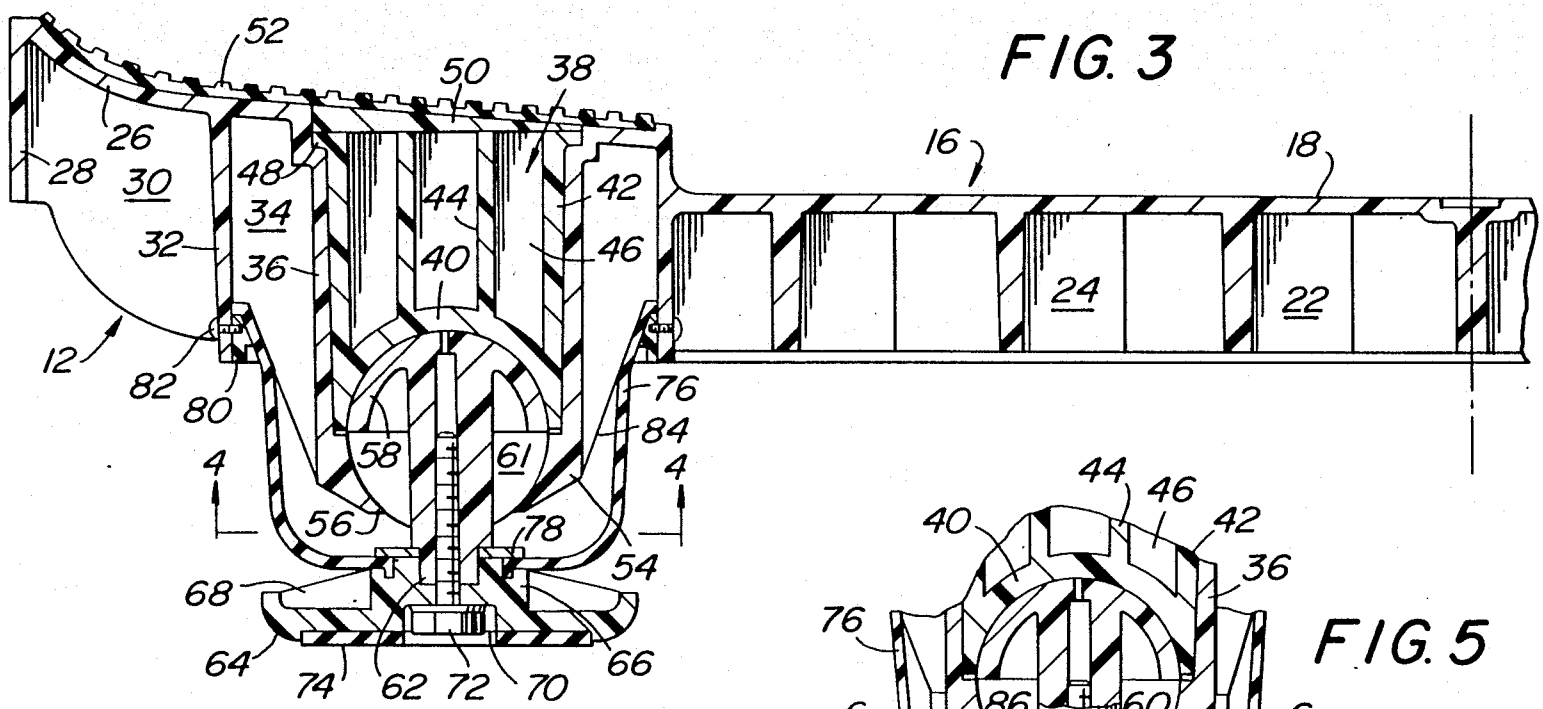
FIG. 3 is a sectional view taken along the line 3—3 in FIG. 1 but on an enlarged scale.

The pads 12 and 14 are identical. Hence, only pad 12 would be described in detail. Referring to FIGS. 2 and 3, it will noted that the pad 12 has a top wall 26 which is arced upwardly at its outer periphery and connected to a depending peripheral side wall 28. Side wall 28 is connected by way of a plurality of ribs 30 to a first cylindrical wall 32. Wall 32 is integral with and depends from the top wall 26. A second cylindrical wall 36 is integral with and depends from the top wall 26. Wall 36 is longer than wall 32 and is radially inwardly thereof. The walls 32 and 36 are connected by a plurality of radially disposed ribs 34. A bearing retainer designated generally as 38 is disposed within the second cylindrical wall 36.

As shown more clearly in FIG. 3, the bearing retainer 38 has a generally semi-spherical end wall 40 at one end of a cylindrical outer wall 42. End wall 40 is also integral on one piece with an inner cylindrical wall 44. The walls 42, 44 are interconnected by radially disposed ribs 46. The upper end of cylindrical wall 42 has an outwardly projecting flange 48 supported by a shoulder at the upper end of cylindrical wall 36. A cover 50 overlies the bearing insert 38. An anti-slip covering 52 overlies and is bonded to the upper surface of cover 50 and the top wall 26 of the pad 12. It will be noted that cover 50 is of non uniform thickness so as to form a continuation of the top wall 26.

The lower end of cylindrical wall 36 is provided with a radially inwardly extending projection 54. See FIG. 3. Projection 54 terminates in a conical hole 56. The inner surface of projection 54, except for the hole 56, is a semi-spherical surface which mates with the semi-spherical surface on the retainer end wall 40. A generally spherical bearing 58 is retained by said two semi-spherical surfaces. Bearing 58 has a axial stem 60 which is cylindrical. The bearing 58 is solid except for a plurality of cut-out areas 59 uniformly distributed around the bottom half of the bearing 58 to thereby define a plurality of radially disposed ribs 61. See FIG. 4. In the area of the ribs, the bearing 58 is completely spherical.

The cylindrical stem 60 on the bearing 58 terminates at its free end in a projection 62 which is non-circular in cross section. As shown in FIG. 7, projection 62 is rectangular in section. A means is provided for releasibly interconnecting stem 60 with a ground engaging element 64. Element 64 has a raised central hub 66 interconnected with the periphery of the element 64 by a plurality of radially disposed ribs 68 on the upper surface thereof. See FIG. 7. Hub 66 has a central bore enlarged at its upper end to mate with and receive the projection 62. Hence, bearing 68 cannot rotate relative to ground engaging element 64.

The bottom end of the central bore of hub 66 is enlarged so as to define recess 70. Within recess 70 there is received the head of a bolt 72. Bolt 72 is threaded to an internal bore in the stem 60 and bearing 58. The bottom surface of element 64 is recessed to receive a rubber pad 74. Pad 74 is an anti-skid and antislip layer so as to minimize movement between element 64 and a supporting surface such as a floor. Pad 74 occupies substantially the entire bottom surface of element 64.

A flexible resilient enclosure 76 is provided. The lower end of enclosure 76 is provided with a flange received in an annular groove on the top wall of hub 66. A washer 78 overlies the lower end portion of enclosure 76 and engages a shoulder on the stem 60. Hence, tightening of bolt 72 connects bearing 58 to element 64 and at the same time connects the lower end of enclosure 76 to the element 64.

An annular retainer 80 is removably attached to the lower end of the cylindrical wall 32 by a plurality of fasteners 82. Retainer 80 maintains the upper end of the enclosure 76 in contact with the beveled surface 84 on the ribs 34. Enclosure 76 is made from a rubberlike or elastomeric material and prevents foreign matter from entering the area of the bearing retainer 38 and also prevents a child from having his fingers squeezed in the area of the bearing while playing with the device 10.

Figure 5:
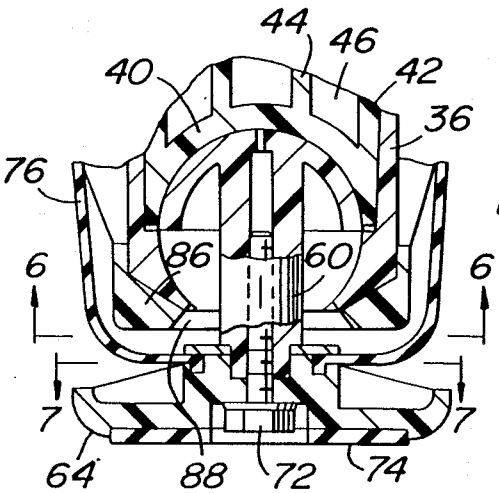
FIG. 5 is a sectional view through the bearing with the removable insert applied thereto.

Beginners have difficulty learning how to maintain their balance on the device 10. To facilitate training beginners, the device 10 is preferably provided with an insert 86 as shown in FIGS. 5 and 6. Insert 86 is removably attached to the lower end of cylindrical wall 36. Insert 86 has a conical opening 88 which coincides with and forms an extension of the opening 56. However, opening 88 is generally elliptical with its major axis lying along the axis of the device 10. Hence, opening 88 will not interfere with the ability of the beginner to tilt pad 14 relative to pad 12 with pad 14 being higher than pad 12 and off the ground. However, insert 88 will limit the extent of tilting of pad 12 relative to its bearing 58 in a direction corresponding to the minor axis of the elliptical opening 88. As soon as a beginner develops the necessary confidence and skill to maintain his balance, insert 88 is easily removed as follows. Fasteners 82 are removed. Bolt 72 is removed. This facilitates axis to removal of the insert 88. Thereafter, bolt 72 is reapplied and fasteners 82 are reapplied.

The device 10 is preferably molded from a polymeric plastic material such as DELRIN except as follows. Coating 52, pad 74, and enclosure 76 are preferably made from neoprene rubber having a durometer of 80–90. The pads 12 and 14, connecting means 16, and cover 50 are preferably made from A.B.S. such as the material sold under the trademark CYCOLAC. Other equivalent polymeric plastics may be used.

The device 10 is easier to use for beginners, while being easier to manufacture and assemble. At the same time, the device 10 is more resistant to torsional twisting along the connecting means. The device 10 is lighter in weight and uses less plastic than that disclosed in the above mentioned patent.

Figures 9, 10, 11:
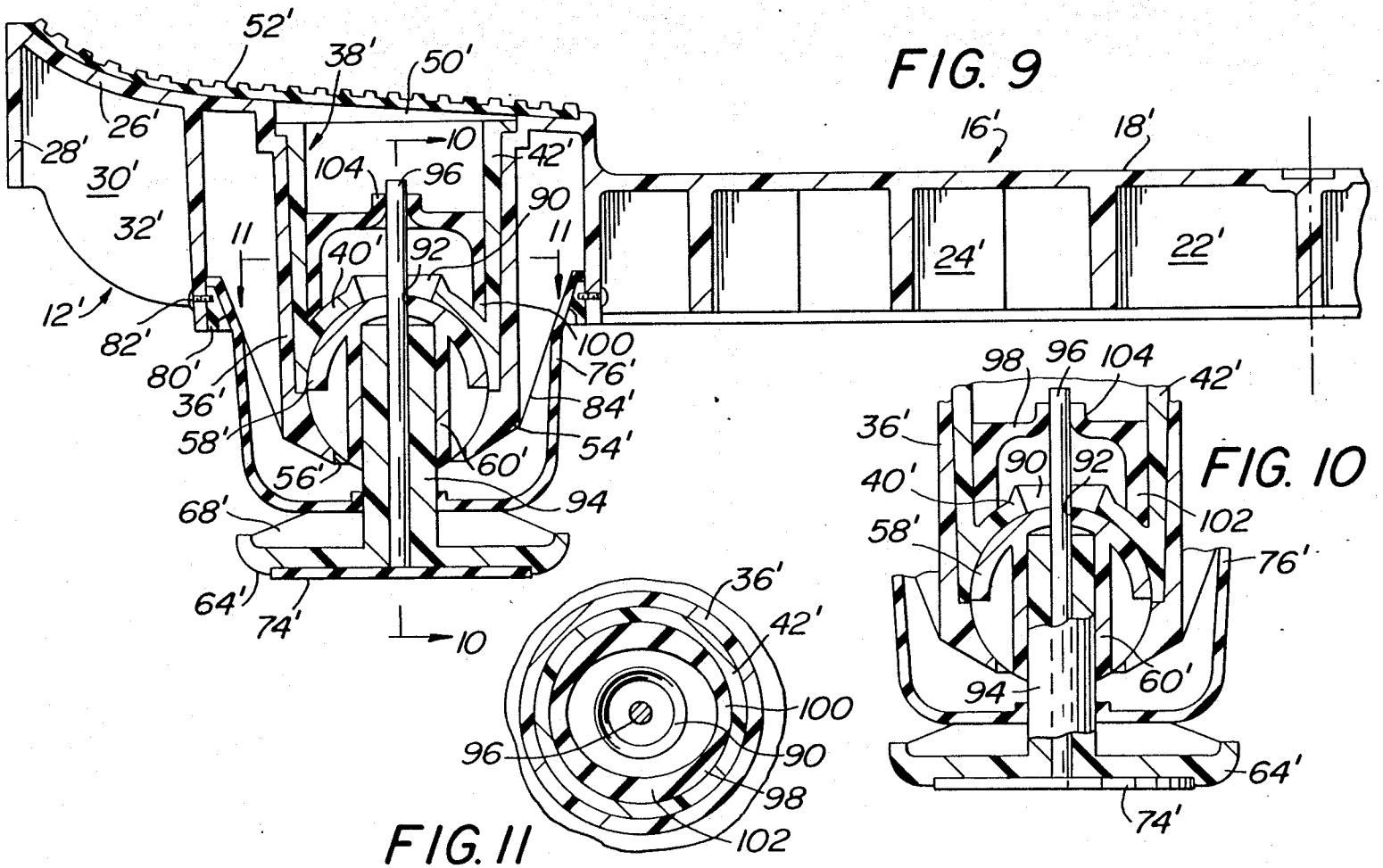
FIG. 9 is a sectional view of an alternate embodiment of the invention taken along the line 3—3 in FIG. 1 but on an enlarged scale.
FIG. 10 is a sectional view taken along the line 10—10 in FIG. 9.
FIG. 11 is a sectional view taken along the line 11—11 in FIG. 9.

FIGS. 9 through 11 illustrate an alternate embodiment of the invention having a different bearing and insert structure. Many of the elements of the embodiment of FIGS. 9 through 11 correspond to like elements illustrated in FIGS. 1 through 9, and accordingly are designated by primed numerals.

The pads 12 and 12′ are for the most part similar. Referring to FIG. 9, it will noted that the pad 12′ has a top wall 26′ which is arced upwardly at its outer periphery and connected to a depending peripheral side wall 28′. Side wall 28′ is connected by way of a plurality of ribs 30′ to a first cylindrical wall 32′. Wall 32′ is integral with and depends from the top wall 26. A second cylindrical wall 36′ is integral with and depends from the top wall 26′. Wall 36′ is longer than wall 32′ and is radially inwardly thereof. The walls 32′ and 36′ are connected by a plurality of radially disposed ribs 34′. A bearing retainer designated generally as 38′ is disposed within the second cylindrical wall 36′. The bearing retainer 38′ has a generally semi-spherical end wall 40′ at one end of a cylindrical outer wall 42′. End wall 40′ has a centrally located axial opening 90 therethrough. The upper end of cylindrical wall 42′ has an outwardly projecting flange 48′ supported by a shoulder at the upper end of cylindrical wall 36′. A cover 50′ overlies the bearing insert 38′. An anti-slip covering 52′ overlies and is bonded to the upper surface of cover 50′ and the top wall 26′ of the pad 12′. It will be noted that cover 50′ is of non uniform thickness so as to form a continuation of the top wall 26′.

The lower end of cylindrical wall 36′ is provided with a radially inwardly extending projection 54′. Projection 54′ terminates in a conical hole 56′. The inner surface of projection 54′, except for the hole 56′, is a semi-spherical surface which mates with the semi-spherical surface on the retainer end wall 40′. A generally spherical bearing 58′ is retained by said two semi-spherical surfaces. Bearing 58 has a axial stem 60′ which is cylindrical. The bearing 58′ is solid except a central opening 92 which is coaxil with opening 90 in end wall 40′ and except for a plurality of cut-out areas uniformly distributed around the bottom half of the bearing 58′ to thereby define a plurality of radially disposed ribs (not shown). In the area of the ribs, the bearing 58′ is completely spherical.

The axial stem 60′ terminates at its free end in a circular opening so that stem 60′ defines a hollow cylinder. Thus, stem 60′ is adapted to receive post 94 which is integral with ground engaging element 64′. The outer diameter of post 94 and inner diameter of stem 60′ are chosen to assure a snug friction fit while still enabling post 94 to be removed if desired. Post 94 has an axial bore (unnumbered) therethrough, which is coaxial with openings 90 and 92.

Post 94 is interconnected with the periphery of element 64′ by a plurality of radially disposed ribs 68′ on the upper surface thereof. Element 64′ is recessed to receive a rubber pad 74′. Pad 74′ is an anti-skid and anti-slip layer so as to minimize movement between element 64′ and a supporting surface such as a floor. Pad 74′ occupies substantially the entire bottom surface of element 64′.

Fixed on pad 74′ and projecting upwardly therefrom is cylindrical pin 96. Pin 96 is located so as to project upwardly through the axial bore in post 94 and through openings 90 and 92. Pin 96 also passes through a central opening (unnumbered) through the top surface of flexible resilient insert 98, to be discussed in greater detail below. The central opening through insert 98 is coaxial with opening 90, opening 92, and the axial bore in post 94.

A flexible resilient enclosure 76' is provided. An annular retainer 80' is removably attached to the lower end of the cylindrical wall 32' by a plurality of fasteners 82'. Retainer 80' maintains the upper end of the enclosure 76' in contact with the beveled surface 84' on the ribs 34'. Enclosure 76' is made from a rubber-like or elastomeric material and prevents foreign matter from entering the area of the bearing retainer retainer 38' and also prevents a child from having his fingers squeezed in the area of the bearing while playing with the device 10.

Beginners have difficulty learning how to maintain their balance on the device 10. To facilitate training beginners, the device 10 is preferably provided with a flexible resilient insert 98. Insert 98 has depending side walls 100 and 102 and is generally cylindrical in shape on its outer surface, and has an outer radius chosen such that insert 98 fits snugly within outer wall 42' of bearing retainer 38'. Insert 98 has a cylindrical shoulder 104 around the opening through the top surface of insert 98 through which pin 96 passes.

As best seen in FIG. 11, the thickness of side walls 100 and 102 is non-uniform, side wall 102 being thicker than side wall 100 such that side walls 100 and 102 define a generally elliptical internal cross-section of insert 98. The major axis of the ellipse lies along the axis of the device 10. Hence, insert 98 will not interfere with the ability of a beginner to tilt pad 12' relative to the opposite pad with pad 12' being higher than the opposite pad. However, insert 98 will limit the extent of tilting of pad 12' relative to its bearing 58' in a direction corresponding to the minor axis of the elliptical opening.

Figure 12:
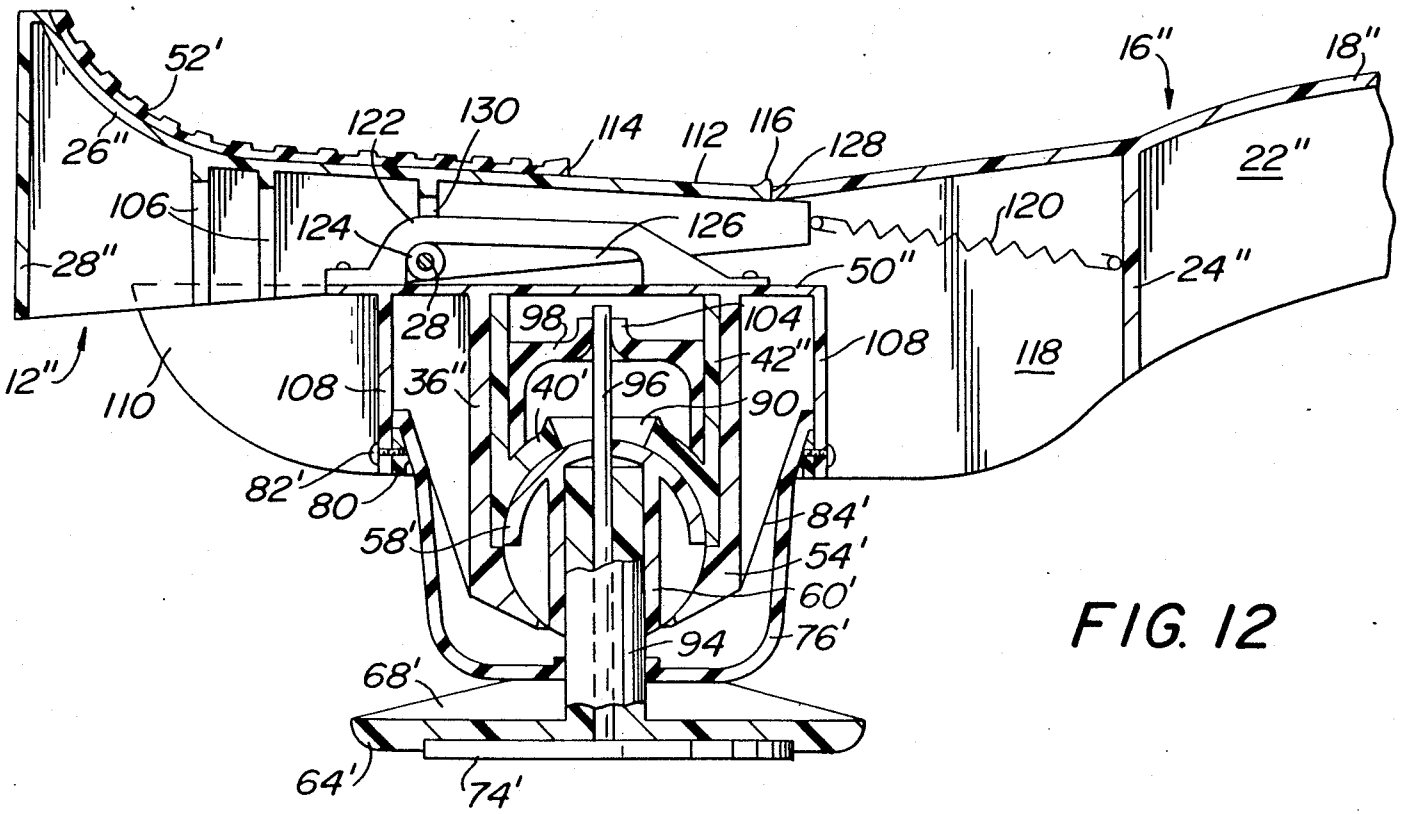
FIG. 12 is a sectional view of still another embodiment of the invention taken along the line 3—3 in FIG. 1 but on an enlarged scale.
Figure 13:
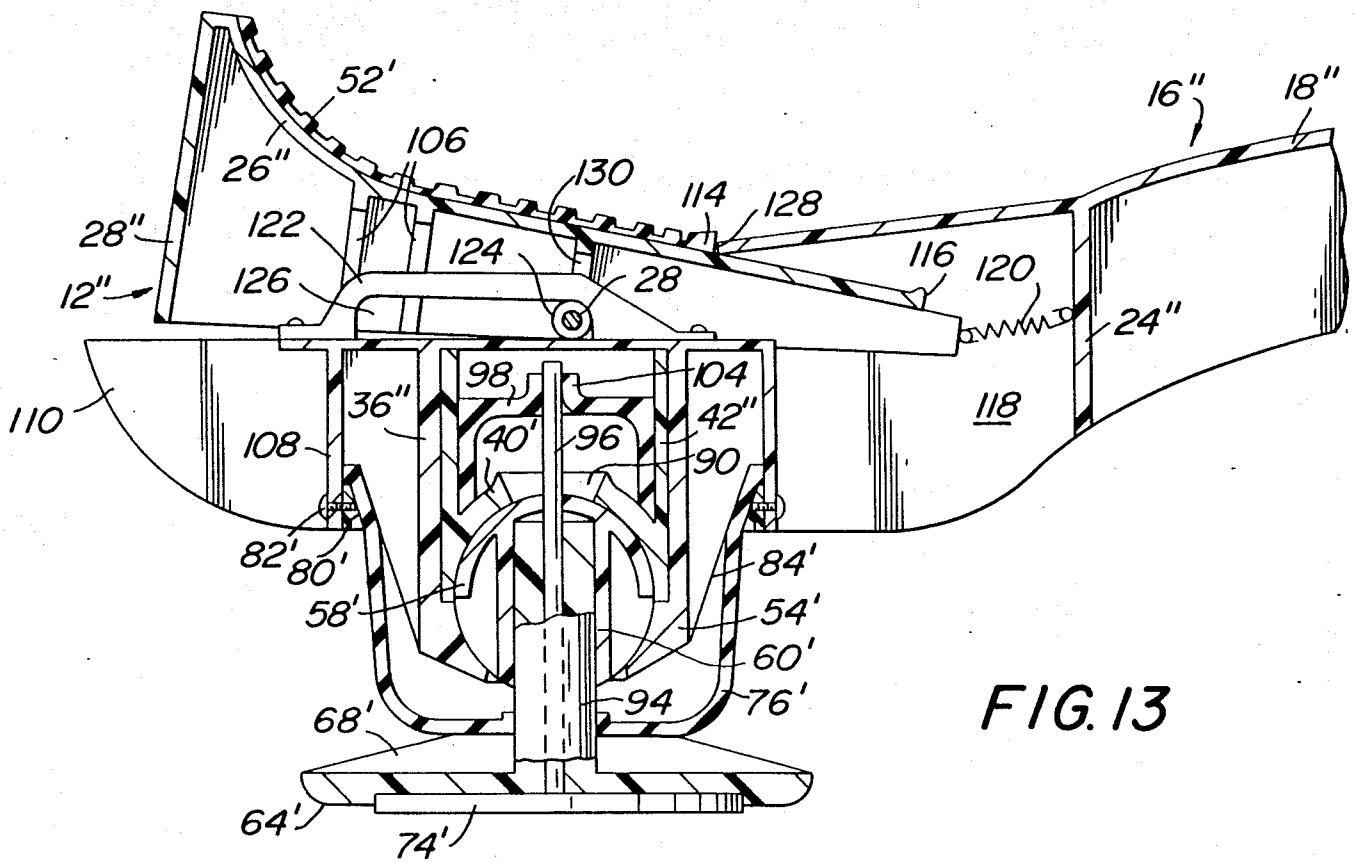
FIG. 13 is the same view as FIG. 12 but with various parts in different positions.

FIGS. 12 and 13 illustrate still another embodiment of the invention, which is designed to facilitate mounting device 10 by beginners. Many beginners may find it difficult to stand on the anti-slip covering 52 with the foot positioned on top of the pivoting point of bearing 58 and then slide the foot outwardly over the anti-slip covering 52 to the ouside of the pivoting point which makes the device 10 work. The embodiment in FIGS. 12 and 13 solves this problem.

Many of the elements illustrated in FIGS. 12 and 13 are identical or similar to elements in FIG. 9, and are designated accordingly. To the extent that elements in FIGS. 12 and 13 are identical to elements already shown and described, they will not be described again.

Referring now to FIG. 12, there is illustrated pad 12'', it being understood that pad 14'' (not shown) is in all respects identical. Pads 22'' and 24'' are rigidly connected together and are integral in one piece by way of a connecting means 16''. The connecting means 16'' includes a top wall 18'' and side walls 20'' (not shown) and 22''. Criss-cross ribbing 24'' is provided to furnish stability and resistance to twisting. The connecting means 16'' is generally an inverted U-shape and transverse cross-section, and has an arc shape in longitudinal cross-section.

Since the pads 12'' and 14'' are identical, only pad 12'' will be described in detail. Pad 12'' has a top wall 26'' which is arced upwardly at its outer periphery and connected to a depending peripheral side wall 28''. Side wall 28'' is reinforced by a plurality of internal depending ribs 106. Ribs 106 are integral with top wall 26'' and side wall 28''.

Pad 12'' is movable longitudinally with respect to connecting means 16''. Top wall 26'' has an extension 112 which extends beyond the end of anti-slip cover 52'. The end of anti-slip cover 52' defines a first stop 114. Extension 112 terminates in a raised second stop 116. Stops 114 and 116 cooperate with stop 128 on connecting means 16''.

Pad 12'' is retained for sliding movement with respect to connecting means 16'' by roller retainer 122, which is mounted on cover 50'' of bearing 38''. Cover 50'' has a top wall and cylindrical side wall 108, within which bearing 38'' is mounted. Cylindrical wall 36'' is integral with and depends downwardly from the underside of cover 50''. The remaining structure of bearing 38'' is essentially identical with that shown in FIGS. 9–11. Alternatively, the bearing disclosed in FIGS. 3 and 5 can be used. Cylindrical side wall 108 is preferably integral with wall 118 on connecting means 16'' and stiffening rib 110, so that bearing 38'' and connecting means 16'' are fixed with respect to each other.

Roller retainer 122 has an elongated opening 126 in which roller 124 is constrained to move longitudinally with respect to connecting means 16''. Roller 124 is journaled for rotation on a cylindrical projection 128 which is preferably integrally molded with stiffening rib 130 in pad 12''. Thus, roller 124 is fixed with respect to pad 12'' and moves with pad 12''.

As shown in FIG. 13, pad 12'' is located in what may be termed the 'mount' position. Pad 12'' is held in this position by spring 120 which biases pad 12'' inwardly. Stop 114 cooperates with stop 128 to limit inward movement of pad 12''. To mount device 10, the user places his foot on pad 12''. The user's weight will be directly over the pivot point of bearing 38'', so that there is no force moment relative to the axis of bearing 38'', and thus there is no movement of pad 12''. This enables the user to mount easily. To use the device, the user merely has to push pad 12'' outwardly against the force of spring 120 and then shift his weight slightly so that stop 116 can engage stop 128 and keep pad 12'' in the second position, or "tilt" position. In this position, the user's weight is now outside the pivot point of bearing 38', which enables the device to freely pivot with respect to the ground. To maintain pad 12'' in this position, all the user need do is maintain outward pressue on pad 12''. To dismount, the user merely has to tilt his foot inwardly, which allows stop 116 to clear stop 128 and allows pad 12'' to move inwardly until stop 114 strikes stop 128, at which point the user's weight is again over the pivot point, and there is no danger of the pad 12'' moving. The user can then simply step off the device.

The present invention may be embodied in other specific forms without departing from the spirit or essential attributes thereof and, accordingly, reference should be made to the appended claims, rather than to the foregoing specification, as indicating the scope of the invention.

I claim:

1. An amusement and/or exercising device comprising first and second pads spaced from each other, each pad being adapted to support one leg of a person, connecting means integral with the pads and having a ribbed cross section which resists twisting and which rigidly interconnects said pads, a discrete ground engaging element below and associated with each pad, each pad having movable foot receiving means movable between a first position proximate said connecting means and a second position away from said connecting means, each pad further having a hollow means defining at its lower end a bearing socket approximately ¾ of a sphere, each hollow means including a first concentric wall extending upwardly from its associated socket and being supported by a shoulder on a second concentric wall of its associated pad, said socket being partially defined by the lower end of said second concentric wall, a generally spherical bearing in each socket, connecting means connecting each bearing in a rigid manner to one of said ground engaging elements, each pad being pivotable relative to its associated bearing through a limited arc to thereby facilitate tilting the pads as a unit with one pad being higher than the other and off the ground, and rotation limiting means for permitting each to rotate through a limited arc relative to its associated ground engaging element in a lengthwise direction of said device while limiting rotation of the pads relative to their associated ground engaging elements in a transverse direction of said device.

2. A device according to claim 1, further comprising first and second stop means on said movable means and stop means on said connecting means operatively associated with said first and second stop means, said first stop means being arranged to contact said connecting means stop to releasably retain said movable means in said first position and said second stop means being arranged to contact said connecting means stop to releasably retain said movable means in said second position.

3. A device according to claim 1, wherein said movable means and said hollow means are slideably connected by roller means on one of said movable means and said hollow means and roller retaining means on the other of said movable means and said hollow means.

4. An amusement and/or exercising device comprising first and second pads spaced from each other, each pad being adapted to support one leg of a person, connecting means integral with the pads and having a ribbed cross section which resists twisting and which rigidly interconnect said pads, a discrete ground engaging element below and associated with each pad, each pad having movable foot receiving means movable between a first position proximate said connecting means and a second position away from said connecting means, each pad further having a hollow means defining at its lower end a bearing socket approximately ¾ of a sphere, upwardly from its associated socket with one of the concentric walls being supported by a shoulder on the outer concentric wall with its associated pad, said socket being partially defined by the lower end of said outer concentric wall, a generally spherical bearing in each socket, connecting means releasibly connecting each bearing in a rigid manner to one of of said ground engaging elements, each pad being pivotable relative to its associated bearing through a limited arc to thereby facilitate tilting the pads as a unit with one pad being higher than the other and off the ground, and removable means for permitting each pad to rotate through a limited arc relative to its associated ground engaging element only in a lengthwise direction of said device.

5. A device according to claim 4, further comprising first and second stop means on said movable means and stop means on said connecting means operatively associated with said first and second stop means, said first stop means being arranged to contact said connecting means stop to releasably retain said movable means in said first position and said second stop means being arranged to contact said connecting means stop to releasably retain said movable means in said second position.

6. A device according to claim 4, wherein said movable means and said hollow means are slideably connected by roller means on one of said movable means and said hollow means and roller retaining means on the other of said movable means and said hollow means.

7. A device in accordance with claim 1, wherein the rotation limiting means comprises a flexible resilient means concentric with and within said first concentric wall and having a top wall and a side wall, the top wall having an opening for receiving means connecting the flexible resilient means to its associated ground engaging element, and the side wall defining a generally elliptical internal opening with the major axis of the ellipse lying substantially along the axis of said connecting means.

8. A device according to claim 7, the side walls of the flexible resilient means being of varying thickness so as to define said generally elliptical opening, the thickness being greater along the portions of the wall generally parallel to the axis of the connecting means.

* * * * *